US010501975B2

(12) United States Patent
Hoermann

(10) Patent No.: US 10,501,975 B2
(45) Date of Patent: Dec. 10, 2019

(54) DOOR, IN PARTICULAR SECTIONAL DOOR, AND DOOR DRIVE

(71) Applicant: Michael Hoermann, Halle (DE)

(72) Inventor: Michael Hoermann, Halle (DE)

( * ) Notice: Subject to any disclaimer, the term of this patent is extended or adjusted under 35 U.S.C. 154(b) by 0 days.

(21) Appl. No.: 15/374,934

(22) Filed: Dec. 9, 2016

(65) Prior Publication Data

US 2017/0167174 A1 Jun. 15, 2017

(30) Foreign Application Priority Data

Dec. 11, 2015 (DE) ..... 10 2015 016 026
Jun. 1, 2016 (DE) ..... 10 2016 006 706

(51) Int. Cl.

| | |
|---|---|
| ***E05D 15/24*** | (2006.01) |
| ***E05D 15/16*** | (2006.01) |
| ***E06B 3/48*** | (2006.01) |
| ***E05D 15/18*** | (2006.01) |
| ***E05F 15/668*** | (2015.01) |

(52) U.S. Cl.

CPC ..... *E05D 15/246* (2013.01); *E05D 15/16* (2013.01); *E05D 15/18* (2013.01); *E05F 15/668* (2015.01); *E06B 3/48* (2013.01); *E05Y 2800/404* (2013.01); *E05Y 2900/106* (2013.01)

(58) Field of Classification Search

CPC ..... E06B 3/485; E05D 15/246; E05D 15/16; E05D 15/18

See application file for complete search history.

(56) References Cited

U.S. PATENT DOCUMENTS 1,990,870 A * 2/1935 Kelly ..... E05D 15/246 16/DIG. 31
2,064,470 A * 12/1936 Heckman ..... E05D 13/1215 16/104
2,573,962 A * 11/1951 Fox ..... E05D 15/246 16/95 R
5,425,409 A * 6/1995 Guia ..... E05D 15/246 160/201
6,089,304 A * 7/2000 Mullet ..... E05D 13/1261 160/193
6,286,277 B1 * 9/2001 Blobaum ..... E05D 15/0608 52/243.1

(Continued)

FOREIGN PATENT DOCUMENTS

DE 10128852 C1 * 7/2002 ..... E05D 15/246
DE 202006013676 U1 6/2007

(Continued)

*Primary Examiner* — Marcus Menezes
(74) *Attorney, Agent, or Firm* — McCoy Russell LLP

(57) ABSTRACT

The present disclosure relates to a door, in particular a sectional door, comprising a door leaf which includes several interconnected panels, pairs of track rollers which are connected with one of the several panels and which are designed to guide a respective panel in guide rails, wherein the door comprises an uppermost pair of track rollers, a bottommost pair of track rollers and at least one middle pair of track rollers, and the uppermost pair of track rollers, the bottommost pair of track rollers and the at least one middle pair of track rollers each run in separate guide rails, and wherein the guide rails of the uppermost pair of track rollers have a course which in one portion has a trough-like shape.

20 Claims, 5 Drawing Sheets

(56) References Cited

U.S. PATENT DOCUMENTS

| | | | | |
|---|---|---|---|---|
| 7,857,031 | B2 * | 12/2010 | Mihalcheon | E05D 15/246 160/201 |
| 8,327,907 | B2 * | 12/2012 | Hoermann | E05D 15/246 160/201 |
| 2003/0062865 | A1 * | 4/2003 | Mullet | E05F 15/668 318/445 |
| 2005/0189079 | A1 * | 9/2005 | Mullet | E05D 15/24 160/201 |
| 2006/0289129 | A1 * | 12/2006 | Mullet | E05F 15/41 160/201 |
| 2009/0194241 | A1 * | 8/2009 | Mihalcheon | E05D 15/246 160/201 |
| 2009/0205258 | A1 | 8/2009 | Hoermann | |
| 2011/0032073 | A1 * | 2/2011 | Mullet | G07C 9/00182 340/5.7 |
| 2017/0167174 | A1 * | 6/2017 | Hoermann | E05F 15/668 |

FOREIGN PATENT DOCUMENTS

| | | | |
|---|---|---|---|
| DE | 202008001121 | U1 | 6/2009 |
| WO | 2007082514 | A1 | 7/2007 |

* cited by examiner

Prior Art

DOOR, IN PARTICULAR SECTIONAL DOOR, AND DOOR DRIVE

CROSS-REFERENCE TO RELATED APPLICATIONS

This application claims priority to German Patent Application No. 10 2015 016 026.5, entitled "Door, in Particular Sectional Door, and Door Drive," filed Dec. 11, 2015; and to German Patent Application No. 10 2016 006 706.3, filed Jun. 1, 2016. The entire contents of each of the above-cited applications are hereby incorporated by reference for all purposes.

TECHNICAL FIELD

This present disclosure relates to a door, in particular a sectional door or side-sliding sectional door, which comprises a plurality of interconnected panels which are guided in guide rails via track rollers. Via a door drive, the door leaf can be transferred at least from a completely open into a closed position.

BACKGROUND AND SUMMARY

For closing the openings of buildings, garages or the like there are generally used doors which are available in a variety of designs, for example in the form of up-and-over doors, overhead doors, roller doors, wing doors, but also as sectional doors. In sectional doors the door leaf consists of several interconnected panels which each are guided in guide rails via track rollers. These sectional doors are guided from a closed position into an open position in that they are guided along the guide rails under the ceiling, for example of the garage.

For reasons of manufacturing costs, assembly costs and also for optical reasons it actually is desirable to put the door together from as little large panels as possible. However, to be able to pull the track rollers of the door along the lateral guide rails, it is necessary that the width of the succeeding panels is comparatively small, so that the roller pairs can run along in the guide rails without polygons. The wider the individual panels become, the larger becomes the radius of the bent transition region of the guide rails, in order to ensure a uniform run. A comparatively large radius of the transition region of the guide rails in turn leads to a large camber above the opening which is to be closed with the garage door. Sectional doors with large panels hence substantially are suitable for building situations in which above the door opening enough space is present for the arrangement of the guide rails. Especially pre-fabricated garages, in which only a comparatively low camber is provided, in general can however not be provided with sectional doors with large panels, as here no high enough camber is available.

On the other hand it is desirable that even when closing with a door, an exchange of air with the environment is achieved upon request. For this purpose it is known already to use various types of ventilation systems. For example, the uppermost panel can be provided with ventilation slots. Alternatively, the bottommost panel also can be provided with a combination of a sealing and ventilation profile in the region of the closing edge.

Independent of the known solutions, there are also known ventilation systems in which in the completely closed position of the door the uppermost panel is folded away towards the inside by a pivoting movement, in order to provide for an air exchange of the region separated by the door with the environment.

From DE 20 2006 013 676 U1 a solution is known in which the door leaf is transferred into a ventilation position by the fact that the anyway present door drive for moving the door leaf at the same time is utilized for tilting the door leaf into a ventilation position. The door, however, is pivoted into a region of the uppermost freely tiltable panel by the carrier driven by means of the door drive, wherein the entire door is lifted off the ground by a gap. Thus, on the one hand a ventilation gap is obtained in the bottom region and a ventilation gap in the upper panel region. The formation of the gap region at the ground, however, is undesirable, as here vermin, for example rats or mice, can slip through the gap. In addition, after formation of the corresponding gap a burglar also might force open the door more easily by means of a corresponding pry tool. To prevent this from happening, DE 20 2006 013 676 U1; provides a separate locking device which secures the door leaf in an approachable ventilation position.

From DE 20 2008 001 121 another solution is known, in which the uppermost panel of a door leaf consisting of several panels can be tilted without a gap being produced between the ground and a panel close to the ground (bottommost panel). The tilting functionality of the uppermost panel is achieved in that a pair of track rollers connected with the uppermost panel is guided in a separate guide rail. The course of the guide rail disclosed in this document is shown in FIG. 1 which will be discussed in detail below. It can be seen that the guide rail for the uppermost pair of track rollers extends substantially horizontally, then transitions into a downwardly directed bend which at a kink point transitions directly into an upwardly directed bend. For tilting the uppermost panel, the upwardly extending bend of the guide rails, which proceeds from the kink point, is utilized to provide for tilting of the panel.

In the above-described design it is disadvantageous that the speed of movement of the door leaf or the panels must be lowered to zero when the uppermost pair of track rollers reaches the kink point, i.e. the lowest point of the guide rails especially provided for the uppermost pair of track rollers. At this point, the slope of the guide rail provided for the uppermost pair of track rollers changes abruptly, so that the speed of movement of the door or the pair of track rollers is throttled very much upon reaching this kink point or even must be decreased to the value zero or a value close to zero. This requires a particularly accurate sensor system, in order to reliably determine the point of reaching the kink point. For the traversing motor of the door leaf or for the door drive it furthermore is disadvantageous that during a closing or opening operation the motor drive cannot simply start or come to rest, but that at the predetermined point, namely upon reaching the kink point by the uppermost pair of track rollers, the motor drive must be braked deliberately before it can start again. It is clear to the skilled person that this inevitably leads to a shortening of the total service life of the drive, as starting and decelerating the drive belongs to the most wear-intensive states of a drive.

Proceeding from the known prior art, it is the object to develop a generic door such that it provides for designing the drive of the door less robust and nevertheless maintain the tilting functionality. Of course, it should also be ensured that the door touches the ground during the ventilation position.

This object is solved by a door comprising a door leaf which includes several interconnected panels, pairs of track rollers which are connected with one of the several panels, and are designed to guide a respective panel in guide rails, wherein the door comprises an uppermost pair of track rollers, a bottommost pair of track rollers and at least one middle pair of track rollers, and the uppermost pair of track rollers, the bottommost pair of track rollers and the at least one middle pair of track rollers each run in separate guide rails, wherein the guide rails of the uppermost pair of track rollers have a course which in one portion has a trough-like shape.

Accordingly, the door which in particular can be a sectional door comprises a door leaf which includes several interconnected panels, pairs of track rollers which are connected with one of the several panels and which are designed to guide a respective panel in guide rails, wherein the door comprises an uppermost pair of track rollers, a bottommost pair of track rollers and at least one middle pair of track rollers, and the uppermost pair of track rollers, the bottommost pair of track rollers and the at least one middle pair of track rollers each run in separate guide rails. The door according to the present disclosure furthermore is wherein the guide rails of the uppermost pair of track rollers have a course which at one portion has a trough-like shape.

The course of the guide rails for the uppermost pair of track rollers has a trough-like shape, i.e. in comparison to a linear extension has a bulge therefrom. This provides the advantage that tilting of the uppermost panel is possible for ventilating the space to be closed with the door, in that the uppermost pair of track rollers, which is connected with the uppermost panel, is moved into the trough in direction of the trough bottom. There is only triggered a tilting movement of the uppermost panel, so that a pulling movement of the other panels, which would lead to opening of the door, is not effected.

For the drive of the door it also is advantageous that the speed of movement from an open state of the door towards a closed state of the door only must be slowed down at an initial point and at an end point and not as previously in the prior art at a kink point in the guide rails associated to the uppermost pair of track rollers. It is clear to the skilled person that the trough shape has no kink points whatsoever, which would necessitate such a behavior.

It furthermore is advantageous that now there is no need anymore for sensors which effect stopping of the uppermost pair of track rollers at exactly the kink point with high reliability.

In general, the guide rail trough-shaped in its course is better for the drive motor of the door, as there is no slowing down and starting in the kink. The trough-shaped guide rails contain no kink or kink point. In addition, the manufacture of the guide rails provided for the uppermost pair of track rollers is simpler than that of guide rails with a kink point.

According to an embodiment, the course of the guide rails provided for the uppermost pair of track rollers is formed by two linear guide rail elements in its trough-like portion. It furthermore is advantageous when the two linear guide rail elements are arranged to each other such that they form a V-shape. The V-shape then is produced by a very open V, in which the angle between the two legs of the V-shape is greater than 90°, alternatively greater than 120°, or alternatively greater than 135°.

According to another modification the guide rails for the uppermost pair of track rollers and/or the bottommost pair of track rollers substantially consist of a plurality of interconnected linear guide rail elements, wherein at their ends protruding from each other the two linear guide rail elements forming the trough-like portion maybe be connected with further guide rail elements which are arranged on a common straight line. Hence, there is a guide rail for the uppermost pair of track rollers which substantially is linear and only is interrupted by the guide rail elements producing a V-shape.

According to another optional embodiment of the present disclosure the course of the guide rails provided for the uppermost pair of track rollers corresponds to a differentiable function in its trough-like portion, which may have an arc-shaped, a wave-shaped or a pan-shaped shape.

Again, this takes account of the fact that the inventive guide rail for the uppermost pair of track rollers has no kink point. A differentiable function is characterized by the fact that the derivative is unambiguous at each of its positions, i.e. has no peaks or kinks. The feature according to which the path of movement of the uppermost pair of track rollers through the guide rails corresponds to a differentiable function or the guide rails provide a path of movement which corresponds to a differentiable function, ensures that the guide rails for the uppermost pair of track rollers have no kink in their path of movement.

In addition it also is possible that the uppermost pair of track rollers can be located in the trough-like part of the associated guide rails, when the bottommost pair of track rollers has reached its end position, and the door is in a completely closed position when the uppermost pair of track rollers has gone through the trough-like part of the guide rails. Proceeding from an open state of the door, the uppermost pair of track rollers hence moves into the trough, goes through the trough valley and leaves the trough, in order to reach a completely closed state of the door. Moving back the uppermost pair of track rollers from a state of the closed door leads to tilting of the uppermost panel when the uppermost pair of track rollers moves in direction of the trough valley. For reaching a tilt position it is of subordinate importance whether or not the uppermost pair of track rollers stops exactly in the lowest point of the trough of the guide rails.

According to another modification of the present disclosure the convex side of the trough-like portion of the course of the guide rails for the uppermost pair of track rollers is aligned downwards and/or the guide rails for the uppermost pair of track rollers are aligned substantially horizontally.

The guide rails for the uppermost pair of track rollers have a linear portion which transitions into the trough-like portion. The trough-like portion thereby falls out of the linear portion and then approximately again leads up to the height of the linear portion after having gone through the trough valley. The guide rail formed in this way substantially is arranged horizontally, wherein the horizontal orientation can be defined with reference to the linear portion. The trough is oriented such that as seen from the linear portion the convex part is oriented downwards, i.e. towards the bottom.

According to an embodiment, the guide rails for the uppermost pair of track rollers are arranged such that in a closed state of the door the end of a guide rail closer to the trough-like part is closer to the panels than the end of the guide rail is to the trough-like part. It thereby is expressed that in a closed state the trough-like part of the guide rails is arranged close to the panels, so that the trough-like part also can effect the tilting function of the uppermost panel.

According to another optional development of the present disclosure the course of the respective guide rails with its trough-like shape each corresponds to a wave-like or pan-like course, which optionally declines into a bend from a linear portion, thereby forms a first pan edge, with a further bend produces the pan bottom and with a last bend produces the second pan edge. Optionally, at the end of the second pan edge the level of the linear portion again is reached in essence, which linear portion transitions into the first pan edge.

Optionally, the uppermost pair of track rollers moves in separate guide rails along the entire path of movement during opening or closing of the door. The guide rails for the uppermost pair of track rollers accordingly are available exclusively for this pair of track rollers and are not shared by another pair of track rollers, for example a middle pair of track rollers or the bottommost pair of track rollers.

According to another embodiment of the present disclosure the guide rails for the at least one middle pair of track rollers comprise a substantially vertical portion and a substantially horizontal portion, which each are connected with each other by an arc-shaped guide rail portion.

It also is possible that the guide rails at least partly consist of sheet-metal sections. Guide rails which at least partly consist of sheet-metal sections are particularly easy to manufacture and very robust.

Optionally, however, the guide rails, in particular the guide rails for the uppermost pair of track rollers consist of a molded plastic part in their bent region.

Furthermore, the present disclosure comprises a door according to any of the embodiments described above, which consists of two or more, in particular three or four panels.

According to another optional modification of the present disclosure the door leaf can be transferred from a completely open into a closed position by means of a door drive. Alternatively, however, the door leaf also can manually be transferable from a completely open into a closed position, which for example is advantageous in the case of a defective motor.

The present disclosure also relates to a door drive for a door according to any of the above-described embodiments for moving a door leaf from a completely open into a closed position and vice versa, comprising a drive motor, a guiding device, a carrier movable by the drive motor along the guiding device, which carrier is connected with the door leaf, and a controller, wherein the drive is wherein on opening of the door from the completely closed state at least one ventilation position initially can be moved to by the controller in that the uppermost panel is tilted, the uppermost pair of track rollers hence is located in the trough-like part of the associated guide rails.

Optionally, different ventilation positions are adjustable by tipping the uppermost panel into different tilt angles.

Further advantages and features of the present disclosure will become apparent in connection with the description of the drawings listed below. The figures are drawn to scale, although other relative dimensions may be used, if desired.

DETAILED DESCRIPTION

Figure 1:
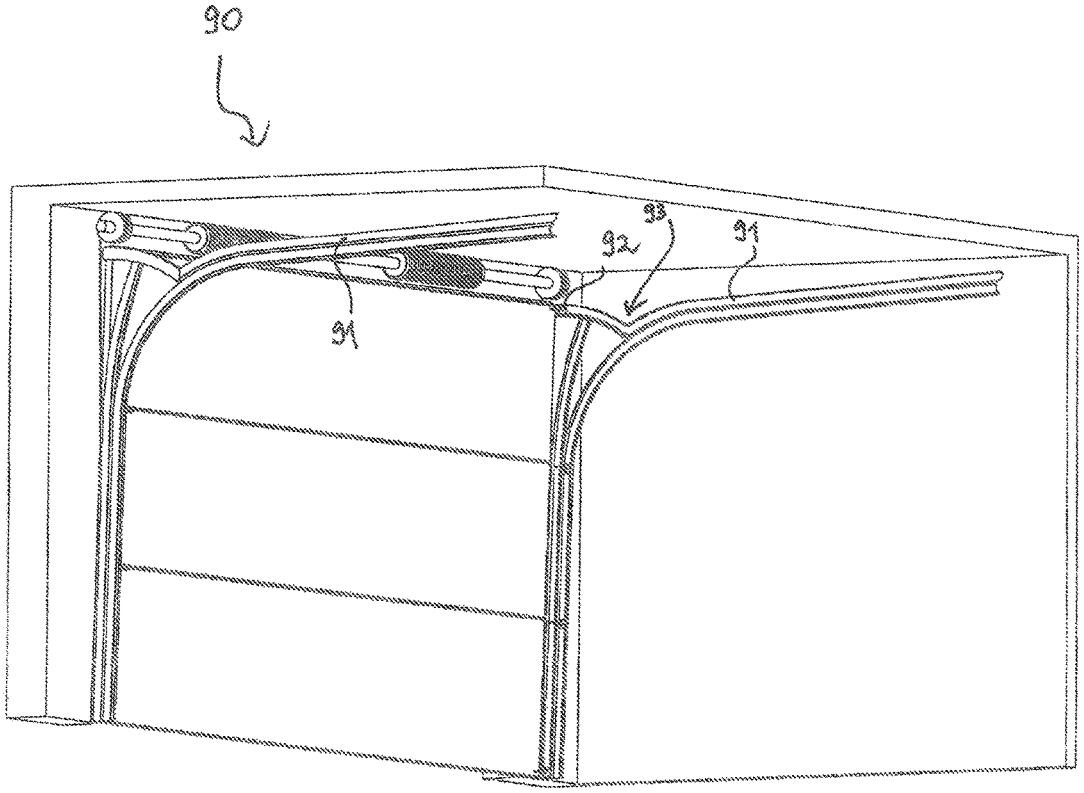
FIG. 1 shows a door according to the prior art, which includes a kink in the guide rails which take up the uppermost pair of track rollers.

FIG. 1 in simplified form shows a perspective view of a door 90 which serves for closing the opening of a prefabricated garage. This door is known already from the prior art. It is typical for the door known in the prior art that the guide rails 91, in which the uppermost pair of track rollers 92 is guided, have a kink. The kink is designated with the reference numeral 93. The disadvantages related therewith have been discussed already in the introductory part of the application, which is why they will not be discussed again.

Figure 2:
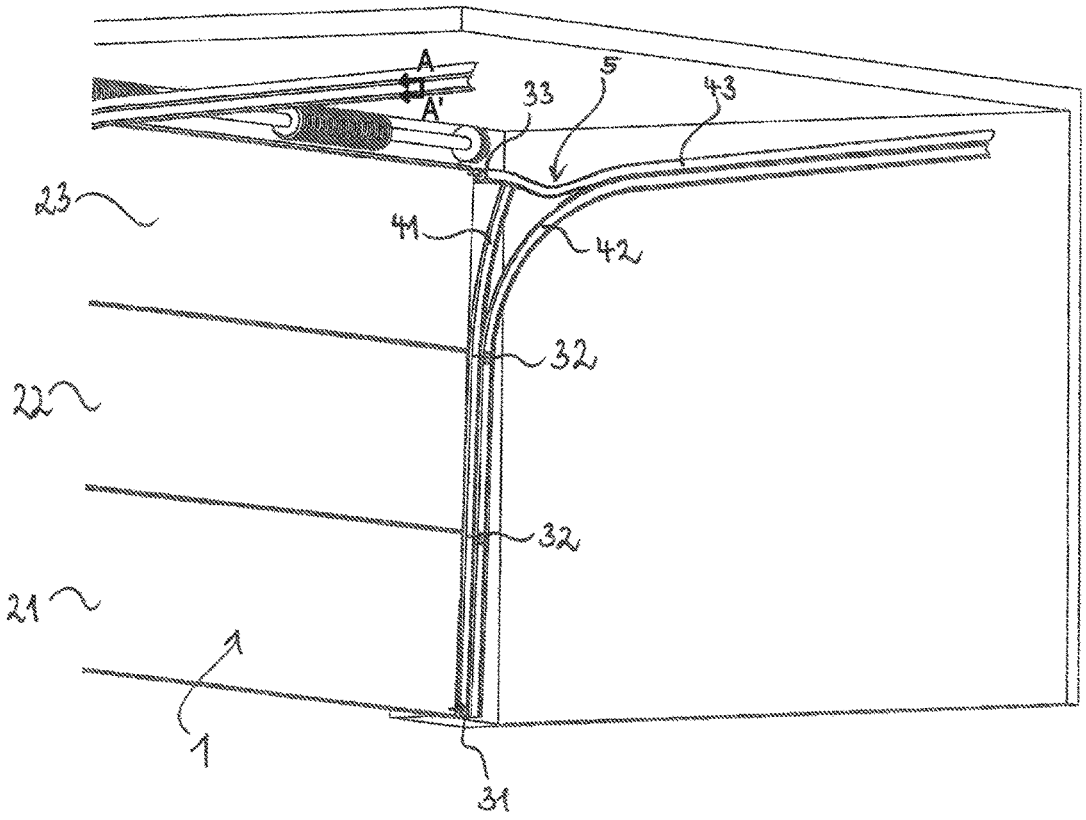
FIG. 2 shows a door according to the present disclosure, whose guide rails for the uppermost pair of track rollers have a course which in one portion has a trough-like shape.

FIG. 2 shows a section of a door 1 illustrated in simplified form in a perspective view, which door is formed as sectional door. It includes a total of three panels 21, 22, 23, which are articulated to each other in a known manner. The lower edge of the bottommost panel 21 forms a closing edge in likewise known manner. On the panels pairs of track rollers 31, 32, 33 are arranged, of which only a part of the pair each is visible. An uppermost pair of track rollers 33 each is arranged laterally at the uppermost end of the upper panel 23. A first middle pair of track rollers 32 is arranged in the upper region of the panel 22 adjoining the uppermost panel at the bottom, while the bottommost panel 21 once includes a middle pair of track rollers 32 in its upper region and in its lower region close to the closing edge includes a bottommost pair of track rollers 31. The pairs of track rollers 31, 32, 33 run in separate guide rails 41, 42, 43 each arranged laterally.

For the middle pair of track rollers 32 there is each provided a guide rail 42 of the guide rail system, which in a known manner consists of a vertical and a horizontal region and a region connecting the same in the shape of an arc.

In FIG. 2 the door 1 is closed completely, wherein for transfer into a partly open or into an open state it is pulled into a non-illustrated carrier along the individual paths of movement of the guide rails 41, 42, 43 upwards into the garage. From the closed state of the door 1, the uppermost panel 23 initially is tilted to the rear, so that the uppermost pair of track rollers 33 comes to lie in the trough-like portion of the guide rails 43.

For a transition of the garage door 1 from a closed state into an open state, a pulling force is applied in the vicinity of the upper edge of the uppermost panel 23 in direction of the garage interior, which due to the trough-like portion 5 need not be slowed down or be decelerated to the value zero or a value close to zero during the movement from the closed position to an open position.

Figure 3:
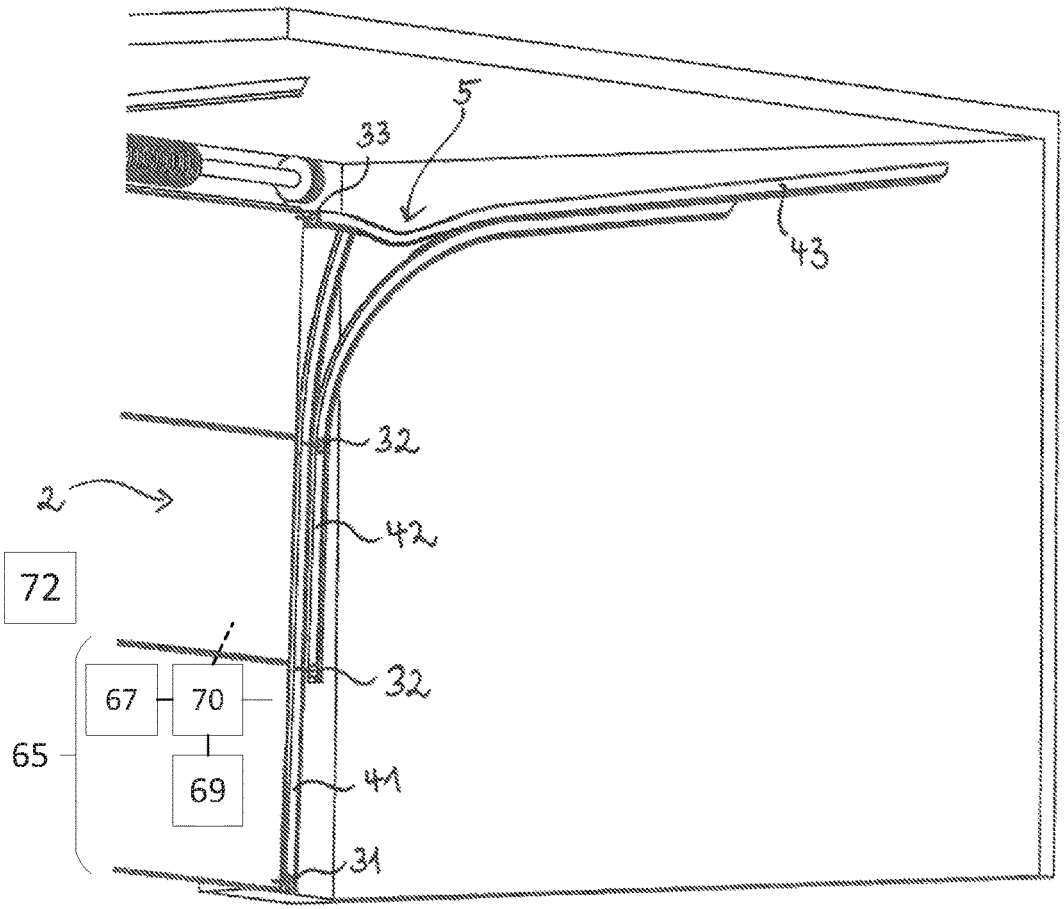
FIG. 3 shows a door according to the present disclosure, in which the guide rails for the at least one middle pair of track rollers are shortened.

FIG. 3 shows an advantageous embodiment of the present disclosure, in which the guide rails 42 of the at least one middle pair of track rollers 32 are shortened. It is not required to let the middle guide rails 42 run as far as the vicinity of a bottom region or to extend the same along the entire length of the guide rails 43 for the uppermost pair of track rollers 33. As shown in FIG. 3, this results from the fact that even in a closed state of the door leaf 2 the bottommost panel 21 does not get near a region close to the ground with its middle pair of track rollers 32.

Conversely, this also applies for the uppermost panel 23 which in a completely open state of the door 1 does not get in the vicinity of the uppermost pair of track rollers 33 with its middle pair of track rollers 32. The guide rails 42 for the at least one middle pair of track rollers therefore can be shortened correspondingly.

In the present exemplary embodiment the door equipped according to the present disclosure was provided with a door drive 65 for a door according to any of the above-described embodiments for moving a door leaf 2 from a completely open into a closed position and vice versa, comprising a drive motor 67, a guiding device 69, a carrier 70 movable by the drive motor 67 along the guiding device 69, which carrier 70 is connected with the door leaf 2, and a controller 72, wherein on opening of the door from the completely closed state at least one ventilation position initially can be moved to by the controller 72 in that the uppermost panel is tilted, the uppermost pair of track rollers hence is located in the trough-like part of the associated guide rails. The present disclosure however does not depend on the presence of a corresponding door drive. A door according to the present disclosure can also be moved manually without leaving the inventive idea. As far as the door is moved manually, the uppermost tiltable panel can be provided with a lock, in order to fix and/or secure the same in a desired ventilation position.

Figure 4A:
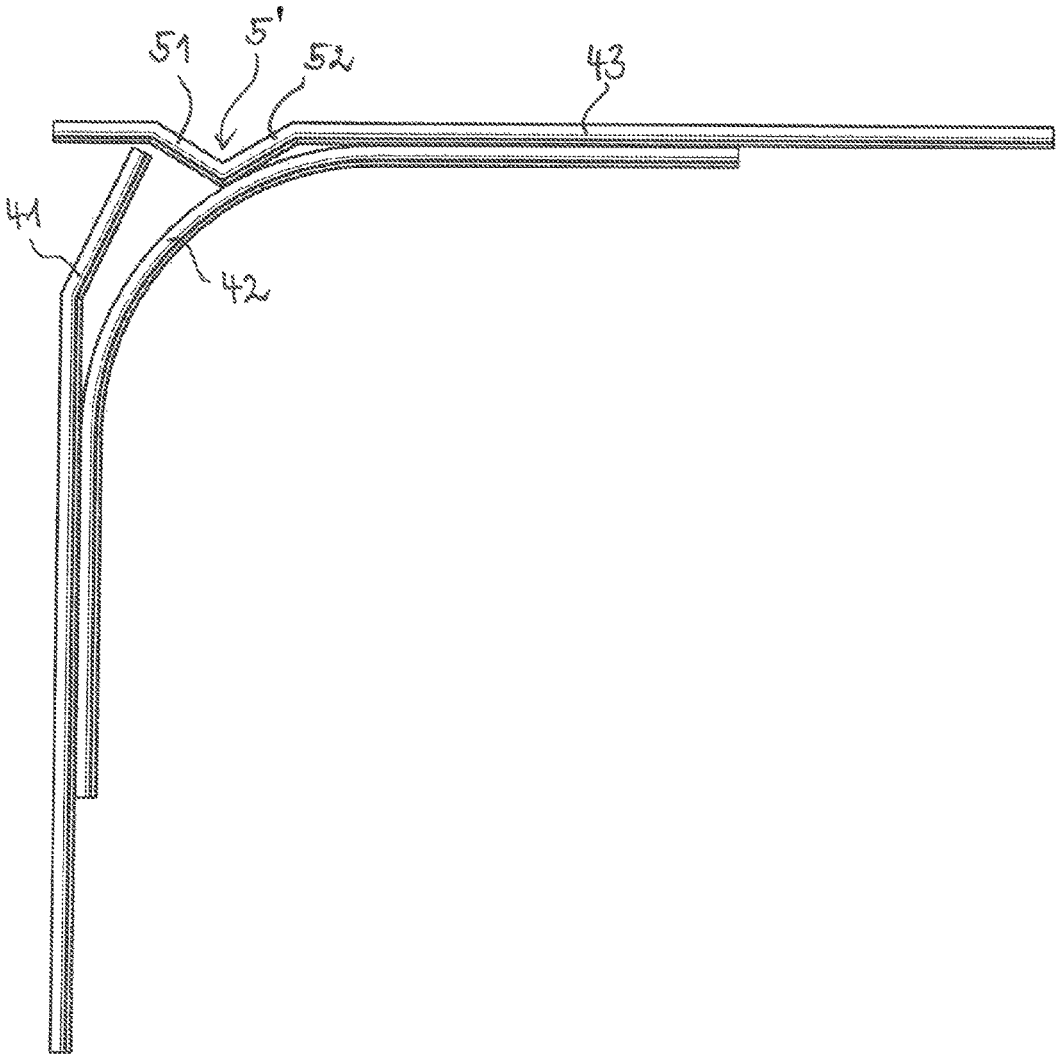
FIG. 4A shows a side view of the guide rails according to the present disclosure.

FIG. 4A shows another embodiment of the present disclosure, in which the guide rails 43, 41 for the uppermost and the bottommost pair of track rollers substantially consist of interconnected linear guide rail elements.

It can be seen that the guide rail 43 for the uppermost pair of track rollers substantially is arranged on a straight line from which only the trough-like shape 5' deviates. The same here is constructed by two linear guide rail elements 51, 52 which together form a V-shape. The two distal ends of the V-shape are connected with the guide rail elements arranged on a straight line.

The guide rail 41 for the bottommost pair of rollers consists of a connection of two substantially linear guide rail elements.

The construction of the guide rails with the linear elements is advantageous with respect to the manufacturing costs, as the materials used therefor need not be bent.

Figure 4B:
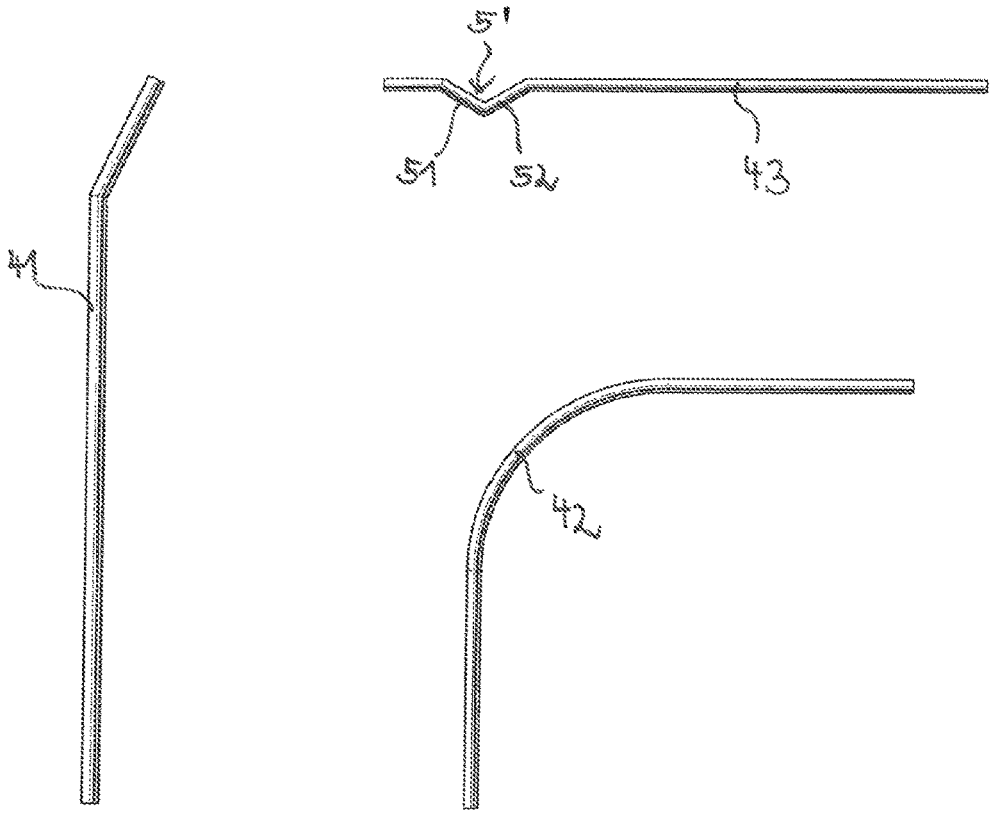
FIG. 4B shows a side view in a spaced arrangement of the guide rails.

FIG. 4B shows the individual guide rails in a view spaced from the other guide rails.

Figure 4C:
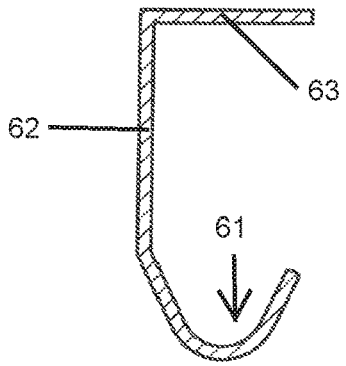
FIG. 4C shows a cross-sectional view A to A' of a guide rail of FIG. 2.

FIG. 4C shows the cross-section A to A' of a guide rail of FIG. 2. In the cross-section it can be seen that the guide rail includes a running groove 61 in which the roller or the rollers are moved. One side of the running groove 61 is adjoined by a side wall 62 which typically is utilized to manufacture an attachment with a wall element of a building. Vertically in cross-section a roof 63 adjoins the side wall 62, which should prevent the ingress of dirt. Between the end of the roof 63 protruding from the side wall 62 and the end of the running groove 61 remote from the side wall 62 an opening is provided, by which a connection with the door guided in the guide rail is accomplished.

FIGS. 1-4C show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The invention claimed is:

1. A door, comprising:

a door leaf which includes several interconnected panels, and pairs of track rollers which are connected to the several panels, wherein the pairs of track rollers are designed to guide a respective panel in guide rails, wherein the pairs of track rollers comprises an uppermost pair of track rollers, a bottommost pair of track rollers, and at least one middle pair of track rollers, the uppermost pair of track rollers, the bottommost pair of track rollers, and the at least one middle pair of track rollers each run in separate guide rails, the guide rails of the uppermost pair of track rollers have a course which in one portion is curvilinear and trough shaped and contains no kink or kink point;

wherein the curvilinear and trough shaped portion of the course of the uppermost pair of track rollers is located between the guide rail for the bottommost pair of track rollers and the guide rail for the at least one middle pair of track rollers; and wherein the guide rail for the bottommost pair of track rollers and the guide rail for the at least one middle pair of track rollers run separately and disconnected from each other and the course of the uppermost guide rail at the curvilinear and trough shaped portion of the course of the uppermost pair of track rollers.

2. The door according to claim 1, wherein the course of the guide rails provided for the uppermost pair of track rollers is formed by two linear guide rail elements in the curvilinear and trough shaped portion of the course.

3. The door according to claim 2, wherein the guide rails for at least one of the uppermost pair of track rollers and the bottommost pair of track rollers substantially consist of a plurality of interconnected linear guide rail elements.

4. The door according to claim 3, wherein the two linear guide rail elements provided for the uppermost pair of track rollers forming the curvilinear and trough shaped portion are connected with further guide rail elements which are arranged on a common straight line.

5. The door according to claim 1, wherein the course of the guide rails provided for the uppermost pair of track rollers is arc-shaped in the curvilinear and trough shaped portion.

6. The door according to claim 1, wherein the uppermost pair of track rollers is located in the curvilinear and trough shaped portion of the respective guide rails of the uppermost pair of track rollers, and, when the bottommost pair of track rollers has reached an end position of the respective guide rails of the bottommost pair of track rollers, the door is in a completely closed position and the uppermost pair of track rollers has gone through the curvilinear and trough shaped portion of the respective guide rails of the uppermost pair of track rollers.

7. The door according to claim 1, wherein at least one of a convex side of the curvilinear and trough shaped portion of the course of the guide rails for the uppermost pair of track rollers is oriented downwards and the guide rails for the uppermost pair of track rollers substantially are oriented horizontally.

8. The door according to claim 1, wherein the guide rails for the uppermost pair of track rollers have a substantially linear part which transitions into the curvilinear and trough shaped portion, and wherein the guide rails for the uppermost pair of track rollers are arranged such that in a closed state of the door an end of each guide rail of the uppermost pair of track rollers closer to the curvilinear trough shaped portion is positioned closer to the panels than an end of each guide rail of the uppermost pair of track rollers which is farther away from the curvilinear and trough shaped portion.

9. The door according to claim 1, wherein the course of the respective guide rails with the curvilinear and trough shaped portion declines in a bend from a linear portion, thereby forming a first edge, with a further bend producing a bottom, and with a last upward bend producing a second edge.

10. The door according to claim 1, wherein, during opening or closing of the door, the uppermost pair of track rollers is running in respective separate guide rails along the uppermost pair of track rollers' entire path of movement.

11. The door according to claim 1, wherein the guide rails for the at least one middle pair of track rollers comprise a substantially vertical portion and a substantially horizontal portion, which each are connected with each other by an arc-shaped guide rail portion.

12. The door according to claim 1, wherein the guide rails of the uppermost pair of track rollers, the bottommost pair of track rollers, and the at least one middle pair of track rollers at least partly consist of sheet-metal sections.

13. The door according to claim 1, wherein the guide rails for the uppermost pair of track rollers consist of a molded plastic part in the curvilinear and trough shaped portion of the guide rails of the course for the uppermost pair of track rollers.

14. The door according to claim 1, wherein the door leaf consists of three or four panels.

15. The door according to claim 1, wherein the door leaf is transferred from a completely open position into a closed position by a door drive.

16. The door according to claim 1, wherein the door leaf is manually transferred from a completely open position into a closed position.

17. The door according to claim 1, wherein the door is a sectional door.

18. The door of claim 1, wherein the guide rail for at least one of the middle pair of track rollers is shorter than the guide rail for the bottommost pair of track rollers.

19. A door drive for a door for moving a door leaf from a completely open position into a closed position and vice versa, wherein the door comprises several interconnected panels of the door leaf, pairs of track rollers are connected with the several panels, and wherein the pairs of track rollers are designed to guide a respective panel in guide rails, the pairs of track rollers comprises an uppermost pair of track rollers, a bottommost pair of track rollers, and at least one middle pair of track rollers, the uppermost pair of track rollers, the bottommost pair of track rollers, and the at least one middle pair of track rollers each run in separate guide rails, the guide rails of the uppermost pair of track rollers have a course which in one portion has a curvilinear and trough shape containing no kink or kink point, wherein the curvilinear and trough shaped portion of the course of the uppermost pair of track rollers is located between the guide rail for the bottommost pair of track rollers and the guide rail for the at least one middle pair of track rollers; and wherein the guide rail for the bottommost pair of track rollers and the guide rail for the at least one middle pair of track rollers run separately and disconnected from each other and the course of the uppermost guide rail at the curvilinear and trough shaped portion of the course of the uppermost pair of track rollers; and the door drive comprises a drive motor, a guiding device, and a carrier, wherein the carrier is connected with the door leaf, and a controller, wherein, on opening of the door from the closed position, the door is initially moved to at least one ventilation position by the controller such that an uppermost panel of the several interconnected panels is tilted and the upper most pair of the track rollers is located in the curvilinear and trough shaped portion of the course of the respective guide rails of the uppermost pair of track rollers.

20. The door drive according to claim 19, wherein different ventilation positions of the door are adjustable by tilting the uppermost panel by different tilt angles.

* * * * *